US012042701B2

(12) United States Patent
Brubaker et al.

(10) Patent No.: US 12,042,701 B2
(45) Date of Patent: Jul. 23, 2024

(54) GOLF CLUB HEADS WITH ADJUSTABLE WEIGHTING SYSTEM

(71) Applicant: KARSTEN MANUFACTURING CORPORATION, Phoenix, AZ (US)

(72) Inventors: Cole D. Brubaker, Scottsdale, AZ (US); Travis D. Milleman, Phoenix, AZ (US); Cory S. Bacon, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/300,327

(22) Filed: Apr. 13, 2023

(65) Prior Publication Data

US 2023/0330497 A1 Oct. 19, 2023

Related U.S. Application Data

(60) Provisional application No. 63/362,953, filed on Apr. 13, 2022.

(51) Int. Cl.
*A63B 53/04* (2015.01)

(52) U.S. Cl.
CPC .. *A63B 53/0466* (2013.01); *A63B 2053/0491* (2013.01)

(58) Field of Classification Search
CPC ..... A63B 2053/0491
See application file for complete search history.

(56) References Cited

U.S. PATENT DOCUMENTS

| | | | |
|---|---|---|---|
| 6,921,344 | B2 | 7/2005 | Gilbert |
| 7,166,041 | B2 | 1/2007 | Evans |
| 7,611,424 | B2 | 11/2009 | Nagai |
| D618,295 | S | 6/2010 | Llewellyn |
| 7,775,905 | B2 | 8/2010 | Beach |
| 8,016,694 | B2 | 9/2011 | Llewellyn |
| 8,444,505 | B2 | 5/2013 | Beach |
| 8,657,702 | B2 | 2/2014 | Boyd |
| 8,696,491 | B1 | 4/2014 | Myers |
| 8,734,271 | B2 | 5/2014 | Beach |
| D714,409 | S | 9/2014 | Myers |
| 8,870,678 | B2 | 10/2014 | Beach |
| 8,894,506 | B1 | 11/2014 | Myers |
| 9,028,342 | B2 | 5/2015 | Stites |
| 9,084,921 | B1 | 7/2015 | Liang |
| 9,199,145 | B1 | 12/2015 | Myers |

(Continued)

FOREIGN PATENT DOCUMENTS

| | | | |
|---|---|---|---|
| KR | 20060023226 | 3/2006 | |
| WO | WO-2017205699 A1 * | 11/2017 | ..... A63B 53/04 |

(Continued)

*Primary Examiner* — William M Pierce

(57) ABSTRACT

Embodiments of a golf club head having an adjustable weight system. The golf club head having a single, relatively compact channel for receiving a weight assembly. The channel does not comprise any threaded bores in or through the walls of the channel. The weight assembly comprises a single weight and a screw. The weight comprises a threaded bore configured to receive the screw. The channel further comprises notches and locating features to position the weight in distinct, prescribed positions. The locating features, notches, and screw are concentric to one another in a final, assembled configuration.

20 Claims, 5 Drawing Sheets

(56) References Cited

U.S. PATENT DOCUMENTS

| | | | | |
|---|---|---|---|---|
| 9,289,660 | B1 | 3/2016 | Myers | |
| 9,364,729 | B2 | 6/2016 | Myers | |
| 9,387,377 | B2 | 7/2016 | Liang | |
| 9,623,294 | B1 | 4/2017 | Kingston | |
| 9,630,069 | B2 | 4/2017 | Foster | |
| 9,682,296 | B1 | 6/2017 | Myers | |
| 9,694,261 | B2 | 7/2017 | Nunez | |
| 9,731,175 | B1 | 8/2017 | Myers | |
| 9,937,392 | B2 | 4/2018 | Myers | |
| 9,956,462 | B2 | 5/2018 | Nunez | |
| 10,112,085 | B2 | 10/2018 | Beach | |
| 10,398,952 | B1 * | 9/2019 | Yi | A63B 53/0433 |
| 10,463,934 | B2 | 11/2019 | Beach | |
| 10,556,161 | B2 | 2/2020 | Jertson | |
| 10,653,926 | B2 | 5/2020 | Story | |
| 10,695,628 | B1 | 6/2020 | Yi | |
| 10,881,927 | B2 | 1/2021 | Beach | |
| 10,888,751 | B1 | 1/2021 | Frederickson | |
| 10,918,917 | B2 | 2/2021 | Northcutt | |
| 10,926,143 | B2 | 2/2021 | Bennett | |
| 10,940,373 | B2 | 3/2021 | Milleman | |
| 10,974,109 | B2 | 4/2021 | Stokke | |
| 10,987,551 | B2 | 4/2021 | Morales | |
| D919,024 | S | 5/2021 | Bacon | |
| 11,033,782 | B1 * | 6/2021 | Evans | A63B 53/0466 |
| 11,090,536 | B2 | 8/2021 | Bennett | |
| 11,161,023 | B2 | 11/2021 | Frederickson | |
| 11,207,577 | B1 | 12/2021 | Evans | |
| 2017/0173413 | A1 * | 6/2017 | Cleghorn | A63B 60/02 |
| 2020/0197769 | A1 * | 6/2020 | Stokke | A63B 53/0433 |
| 2021/0086042 | A1 | 3/2021 | Story | |
| 2021/0093935 | A1 | 4/2021 | Jertson | |
| 2021/0128994 | A1 | 5/2021 | Yi | |
| 2021/0138318 | A1 | 5/2021 | Northcutt | |
| 2021/0138319 | A1 | 5/2021 | Bennett | |
| 2021/0178234 | A1 | 6/2021 | Beach | |
| 2021/0268347 | A1 | 9/2021 | Yi | |
| 2021/0402270 | A1 | 12/2021 | Bennett | |
| 2022/0347530 | A1 * | 11/2022 | Northcutt | A63B 53/0433 |
| 2023/0086761 | A1 * | 3/2023 | Dixon | A63B 53/08 473/306 |
| 2023/0330497 | A1 * | 10/2023 | Brubaker | A63B 60/02 |
| 2023/0330499 | A1 * | 10/2023 | Yi | A63B 60/52 |
| 2024/0017137 | A1 * | 1/2024 | Yi | A63B 60/02 |
| 2024/0017138 | A1 * | 1/2024 | Sanchez | A63B 60/02 |
| 2024/0017139 | A1 * | 1/2024 | Bacon | A63B 60/02 |

FOREIGN PATENT DOCUMENTS

| | | |
|---|---|---|
| WO | 2019035912 | 2/2019 |
| WO | 2021113877 | 6/2021 |

* cited by examiner

GOLF CLUB HEADS WITH ADJUSTABLE WEIGHTING SYSTEM

CROSS REFERENCE PRIORITIES

This claims the benefit of U.S. Provisional Application No. 63/362,953, filed Apr. 13, 2022, the contents of which are fully incorporated herein by reference.

TECHNICAL FIELD

This disclosure relates generally to golf equipment and, more particularly, relates to golf club heads having an adjustable weight system.

BACKGROUND

In the past, golf club designers have utilized adjustable weighting systems to provide the end user the ability to alter and control the center of gravity position to help provide a desired shot shape. These adjustable weighting systems come in many different configurations with different features. In some weighting systems, the weight may comprise two separate pieces which slide along a track and are held to rails in the track by clamping the two pieces to the track. In other weighting systems, the weight may be screwed into a threaded aperture provided in the body of the club head. Many weight systems require a significant amount of mass and structural buildup which pushes the center of gravity forward and reduce the moment of inertia of the club head. The adjustable weight systems have high manufacturing costs due to machining costs and complex assemblies. Therefore, there is a need in the art for a weighting system that reduces the number of parts and manufacturing costs while still providing adjustability and improved mass properties such as a low center of gravity and high moment of inertia.

BRIEF DESCRIPTION OF THE DRAWINGS

To facilitate further description of the embodiments, the following drawings are provided in which.

Figure 1:
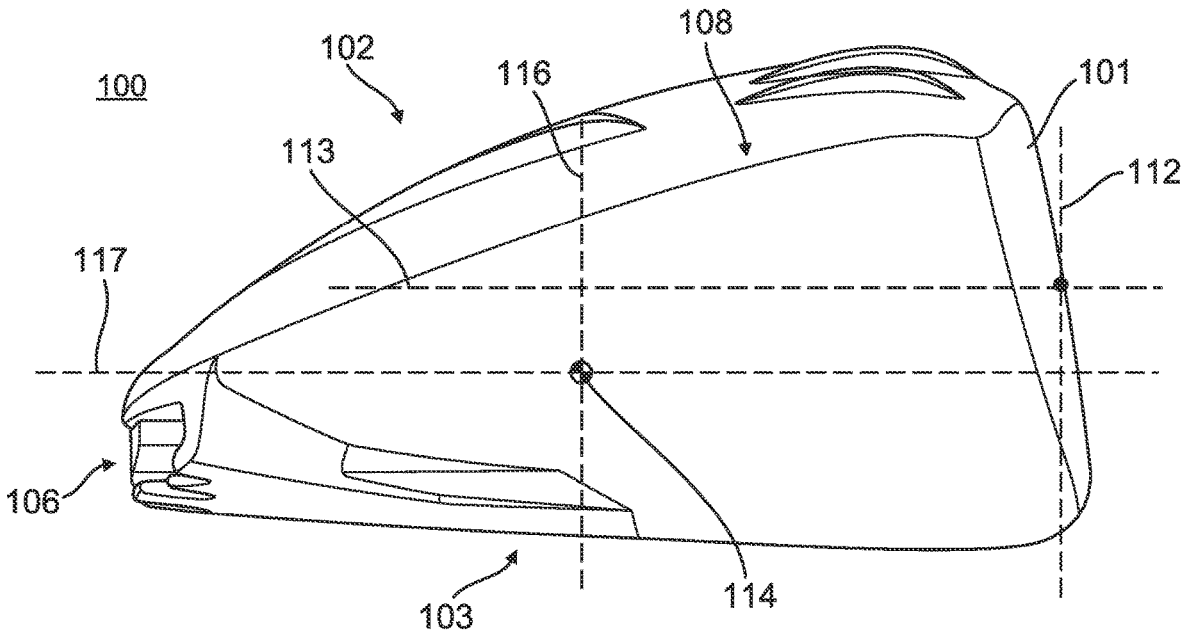
FIG. 1 illustrates a toe side view of a golf club head according to an embodiment of the present invention.

Described herein is an adjustable weighting system for a wood-type club head. The adjustable weighting system of the wood-type club head removes the need for threaded bores in the club head body. Removing the need for threaded bores in the wood-type club head (hereafter 'club head body') simplifies the manufacturing process and reduces costs. Specifically, machining threaded bores in a titanium body may cost upwards of one U.S. dollar per threaded bore. A weighting system usually requires three or more threaded bores. As such, removing the threaded bore may save at least three U.S. dollars per manufactured club heads. This results in at least 4% cost savings for the overall manufactured club head.

The adjustable weight system further balances the center of gravity location and moment of inertia by utilizing a comparatively small weight channel located an extreme perimeter location. The weight channel saves discretionary mass from the reduced channel size that can be allocated to the weight to make a comparatively heavy weight. The heavy weight will counter-balance the small weight channel and provide sufficient adjustability of the center of gravity in a heel-toe direction.

Furthermore, the adjustable weighting system described herein allows for the use of heavy weights, while maintaining stability and durability of the club head. Threaded bores in the body create porosity and thereby increase the chance of failure or cracking. Removing the threaded bores in the body decreases the porosity of the club head. Decreasing the porosity of the club head improves durability, allowing for heavier weights to be used in the weight system.

Even further, the adjustable weight system described herein improves user interface and ease of use. The weight channel comprises notches and locating features which guide the weight into specific locations. This prevents the golfer from being provided unlimited position choices that create confusing in determining shot shape and flight of the golf ball. The weight channel also prevents the golfer from having to locate or guide a screw into a thread found in other weight systems. The notches of the weight system described herein guide the weight into position by aligning the screw with locating features in the top wall so the user does not have to located the threaded bores.

Definitions

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "strike face," as used herein, refers to a club head front surface that is configured to strike a golf ball. The term strike face can be used interchangeably with the term "face."

The term "strike face perimeter," as used herein, can refer to an edge of the strike face. The strike face perimeter can be located along an outer edge of the strike face where the curvature deviates from a bulge and/or roll of the strike face.

The term "geometric centerpoint," or "geometric center" of the strike face, as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as used herein, can refer to a reference plane associated with the surface on which a golf ball is placed. The ground plane can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the loft plane and the XY plane (defined below).

The term "face height," as used herein, can refer to a distance measured parallel to loft plane between a top end of the strikeface perimeter and a bottom end of the strikeface perimeter.

The term "lie angle," as used herein, can refer to an angle between a hosel axis, extending through the hosel, and the ground plane. The lie angle is measured from a front view.

The "depth" of the golf club head, as used herein, can be defined as a front-to-rear dimension of the golf club head.

The "height" of the golf club head, as used herein, can be defined as a crown-to-sole dimension of the golf club head. In many embodiments, the height of the club head can be measured according to a golf governing body such as the United States Golf Association (USGA).

The "length" of the golf club head, as used herein, can be defined as a heel-to-toe dimension of the golf club head. In many embodiments, the length of the club head can be measured according to a golf governing body such as the United States Golf Association (USGA).

The "face height" of the golf club head, as used herein, can be defined as a height measured parallel to loft plane between a top end of the strike face perimeter near the crown and a bottom end of the strike face perimeter near the sole.

The "geometric center height" of the golf club head, as used herein, is a height measured perpendicular from the ground plane to the geometric centerpoint of the golf club head.

The "leading edge" of the club head, as used herein, can be identified as the most sole-ward portion of the strike face perimeter.

Figure 2:
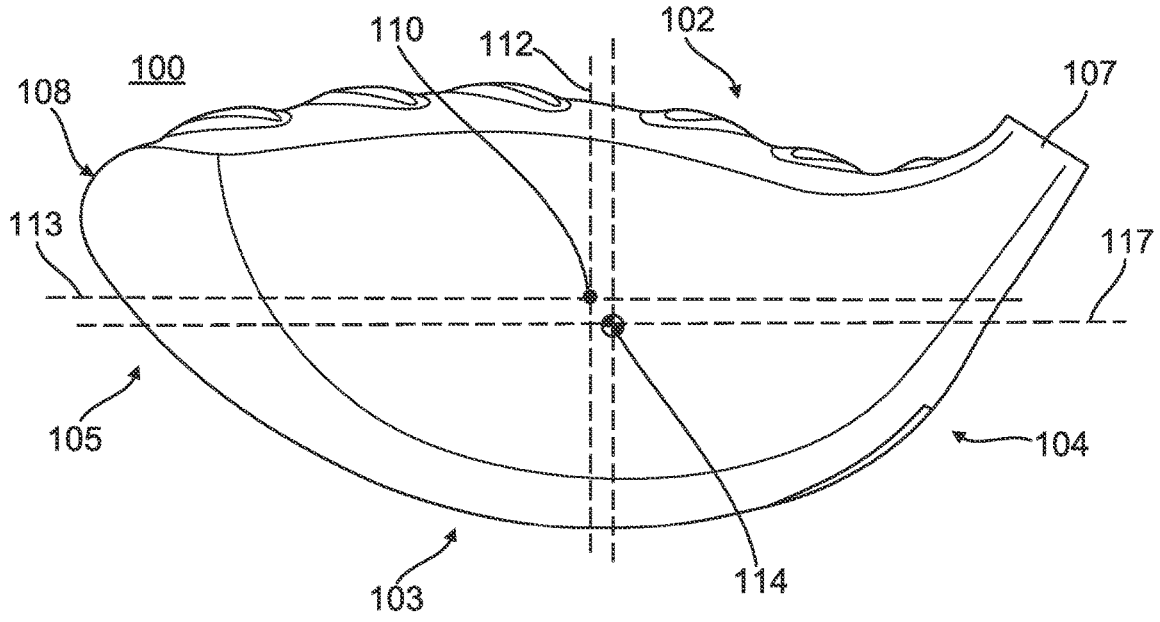
FIG. 2 illustrates a front view of the golf club head of FIG. 1.

An "XYZ" coordinate system of the golf club head, as used herein and illustrated in FIGS. 1 and 2, is based upon the geometric center 110 of the strike face 101. The golf club head dimensions as used herein can be measured based on a coordinate system as defined below. The geometric center 110 of the strike face defines a coordinate system having an origin located at the geometric center 110 of the strike face. The coordinate system defines an X axis 111, a Y axis 112, and a Z axis 113. The X axis 111 extends through the geometric center 110 of the strike face in a direction from the heel to the toe of the club head. The Y axis 112 extends through the geometric center of the strike face in a direction from the crown to the sole of golf club head. The Y axis 112 is perpendicular to the X axis 111. The Z axis 113 extends through the geometric center of the strike face in a direction from the front end to the rear end of the golf club head. The Z axis 113 is perpendicular to both the X axis 111 and the Y axis 112.

The term or phrase "center of gravity position" or "CG location" can refer to the location of the club head center of gravity 114 (CG) with respect to the XYZ coordinate system, wherein the CG 114 position is characterized by locations along the X-axis 111, the Y-axis 112, and the Z-axis 113. The term "CGx" can refer to the CG location along the X-axis, measured from the origin point. The term "CG height" can refer to the CG location along the Y-axis, measured from the origin point. The term "CGy" can be synonymous with the CG height. The term "CG depth" can refer to the CG location along the Z-axis, measured from the origin point. The term "CGz" can be synonymous with the CG depth.

The XYZ coordinate system of the golf club head, as used herein defines an XY plane extending through the X axis and the Y axis. The coordinate system defines XZ plane extending through the X axis and the Z axis. The coordinate system further defines a YZ plane extending through the Y axis and the Z axis. The XY plane, the XZ plane, and the YZ plane are all perpendicular to one another and intersect at the coordinate system origin located at the geometric center of the strike face. In these or other embodiments, the golf club head can be viewed from a front view when the strike face is viewed from a direction perpendicular to the XY plane. Further, in these or other embodiments, the golf club head can be viewed from a side view or side cross-sectional view when the heel is viewed from a direction perpendicular to the YZ plane.

The golf club head further comprises a coordinate system centered about the center of gravity 114. The coordinate system comprises an X'-axis 115, a Y'-axis 116, and a Z'-axis 117. The X'-axis 115 extends in a heel-to-toe direction. The X'-axis is positive towards the heel and negative towards the toe. The Y'-axis 116 extends in a sole-to-crown direction and is orthogonal to both the Z'-axis and the X'-axis. The Y'-axis is positive towards the crown and negative towards the sole. The Z-axis extends front-to-rear, parallel to the ground plane and is orthogonal to both the X'-axis and the Y'-axis. The Z'-axis is positive towards the strike face and negative towards the rear.

The term or phrase "moment of inertia" (hereafter "MOI") can refer to values measured about the CG. The term "MOIxx" can refer to the MOI measured in the heel-to-toe direction, parallel to the X'-axis. The term "MOIyy" can refer to the MOI measured in the sole-to-crown direction, parallel to the Y-axis. The term "MOIzz"

can refer to the MOI measured in the front-to-back direction, parallel to the Z-axis. The MOI values MOIxx, MOIyy, and MOIzz determine how forgiving the club head is for off-center impacts with a golf ball.

A "driver-type golf club head," also referred to as a driver, as used herein, can be defined by specific dimensional ranges. In particular, the driver, as described with regard to the invention disclosed herein, includes a loft angle, volume, length, depth, and height within the ranges defined below. The driver is typically the longest club in a players bag and is designed to, but not limited to, hit the furthest shot off of a tee.

The "loft angle" of the driver, as described above, can be less than approximately 16 degrees, less than approximately 15 degrees, less than approximately 14 degrees, less than approximately 13 degrees, less than approximately 12 degrees, less than approximately 11 degrees, or less than approximately 10 degrees.

The volume of the driver can be greater than approximately 300 $cm^3$, greater than approximately 350 $cm^3$, greater than approximately 400 $cm^3$, greater than approximately 425 $cm^3$, greater than approximately 450 $cm^3$, greater than approximately 475 $cm^3$, greater than approximately 500 $cm^3$, greater than approximately 525 $cm^3$, greater than approximately 550 $cm^3$, greater than approximately 575 $cm^3$, greater than approximately 600 $cm^3$, greater than approximately 625 $cm^3$, greater than approximately 650 $cm^3$, greater than approximately 675 $cm^3$, or greater than approximately 700 $cm^3$.

The height of the driver can be greater than 2.0 inches, greater than 2.1 inches, greater than 2.2 inches, greater than 2.3 inches, greater than 2.4 inches, or greater than 2.5 inches. The height of the driver can be less than 3.0 inches, less than 2.9 inches, less than 2.8 inches, less than 2.7, less than 2.6 inches, or less than 2.5 inches.

The face height of the driver can be between 1.3 inches (33 mm) and 3.8 inches (71 mm). The face height of the driver can be 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.3 inches, 3.4 inches, 3.5 inches, 3.6 inches, 3.7 inches, or 3.8 inches.

The driver can comprise a mass between 185 grams and 225 grams. The mass of the driver can range between 185 grams and 190 grams, between 190 grams and 195 grams, between 195 grams and 200 grams, between 200 grams and 205 grams, between 205 grams and 210 grams, between 210 grams and 215 grams, between 215 grams and 220 grams, or between 220 grams and 225 grams.

A "fairway-type golf club head" as used herein is a club head having particular lofts, volumes, and dimensions that can be defined by specific dimensional ranges. In particular, the fairway-type club head, as described with regard to the invention disclosed herein, includes a loft angle, volume, length, depth, height, and face height within the ranges defined below. The specified ranges below limit the fairway-type golf club head to a fairway-type club head. Furthermore, a fairway-type golf club head is typically the second and/or third longest club in a Player's bag. The fairway-type golf club head is designed to, but not limited to, hit the longest shots off of the ground, typically from a fairway. In other words, the fairway-type golf club head cannot be a driver type, a hybrid-type, an iron-type, or a putter-type golf club head.

The "loft angle" of the fairway-type club head as used herein can be less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, or less than approximately 25 degrees. In some embodiments, the loft angle of the fairway-type golf club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees. For example, in some embodiments, the loft angle of the fairway-type golf club head can be between 14 degrees and 35 degrees, between 15 degrees and 35 degrees, between 20 degrees and 35 degrees, or between 12 degrees and 30 degrees.

The "volume" of the fairway-type club as used herein can be less than approximately 170 $cm^3$, less than approximately 180 $cm^3$, less than approximately 190 $cm^3$, or less than approximately 200 $cm^3$. However, the volume of the fairway-type club cannot be less than 160 $cm^3$. In some embodiments, the volume of the fairway-type club head can be between approximately 150 $cm^3$ to 200 $cm^3$, between approximately 160 $cm^3$ to 170 $cm^3$, between approximately 160 $cm^3$ to 180 $cm^3$, or between approximately 170 $cm^3$ to 190 $cm^3$. The volume of the fairway-type club cannot be greater than 200 $cm^3$. In one exemplary embodiment, the volume of the fairway-type club is 169 $cm^3$.

The "depth" of the fairway-type golf club can be in a range of between 3.00 inches to 4.00 inches. In some embodiments, the depth can be between 3.00 inches to 3.40 inches, between 3.25 inches to 3.40 inches, between 3.30 inches to 3.50 inches, or between 3.50 inches to 4.00 inches. The depth cannot be greater than 4.00 inches.

The "height" of the fairway-type golf club head can be in a range of between 1.25 inches to 2.00 inches. In some embodiments, the height 164 can be between 1.25 inches to 1.50 inches, between 1.30 inches to 1.50 inches, between 1.35 inches to 1.75 inches, between 1.45 inches to 1.80 inches, or between 1.50 inches to 2.00 inches. In one exemplary embodiment, the height is 1.424 inches. The height is not greater than 2.00 inches.

The "length" of the fairway-type golf club head can be in a range of between 3.00 inches to 4.60 inches. In some embodiments, the length can be between 3.00 inches to 4.00 inches to 4.40 inches, between 4.25 inches to 4.40 inches, or between 4.30 inches to 4.60 inches. The length is not greater than 4.60 inches.

The "face height" of the fairway-type golf club head can range from 1.00 inches to 1.50 inches. In some embodiments, the face height can be between 1.00 inches to 1.25 inches, between 1.00 inches to 1.15 inches, between 1.15 inches to 1.35 inches, or between 1.15 inches to 1.50 inches.

The "geometric center height" of the fairway-type golf club head can range from 0.40 inch to 0.75 inch. For example, the geometric center height can be between 0.40 inch to 0.60 inch, between 0.50 inch to 0.70 inch, or between 0.65 inch to 0.75 inch.

The golf club heads described in this disclosure can be formed from a metal, a metal alloy, a composite, or a combination of metals and composites. For example, the golf club head can be formed from, but not limited to, steel, steel alloys, stainless steel alloys, nickel, nickel alloys, cobalt, cobalt alloys, titanium alloys, an amorphous metal alloy, or other similar materials. For further example, the golf club head can be formed from, but not limited to, C300 steel, C350 steel, 17-4 stainless steel, T9s+ titanium (TP2), HST-220, or Ti-8-1-1. In some embodiments, the T9s+ titanium can have 7.35-8.35% Al, 1.0-1.25% V, 0.15-0.25% Si, ≤0.4% Fe, ≤0.15% O, ≤0.1% C, ≤0.05% N, remaining % Ti, tensile strength minimum 145 ksi, yield strength minimum 130 ksi, Young's modulus of 120 Gpa, Elongation minimum of 9% in/in, and a hardness of 36-42 HRC. In some embodiments the HST-220 can have 7.0-8.0% Al, 2.2-2.8% Mo, 0.5-1.1% V, 1.4-2.0% Cr, 0.25-0.35% Si, ≤0.25% Fe, ≤0.15% 0, ≤0.1% C, ≤0.05% N, remaining % Ti, tensile strength minimum 175 ksi, yield strength minimum 169 ksi, Young's modulus of 134 Gpa, Elongation minimum of 1% in/in, and a hardness of 36-44 HRC. In some embodiments, the Ti-8-1-1 can have 7.35-8.35% Al, 0.75-1.25% V, 0.75-1.25% Mo, ≤0.3% Fe, ≤0.12% O, ≤0.08% C, ≤0.05% N, ≤0.0125% H, and remaining % Ti, tensile strength minimum 148 ksi, yield strength minimum 131 ksi, Young's modulus of 120 Gpa, Elongation minimum of 9% in/in, and a hardness of ~36 HRC.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DESCRIPTION

I. Adjustable Weight System

Described herein are various embodiments of an adjustable weighting system which removes the need for threaded bores in the body of the club head and yet achieves maximum perimeter weight placement for path manipulation and a low and back CG club head. The golf club head can manipulate the path of the golf ball by up to 10 yards in either a draw or fade bias. The adjustable weighting system comprises a channel, a single weight, and a single screw. The channel can be defined by three or more walls. The walls form a void channel open to the outer perimeter of the club head. The channel does not comprise a threaded bore in, or through, the walls of the channel. Instead, the channel comprises locating features and a wall having slots to align the weight in specific and distinct locations. The adjustable weighting system described herein is minimalistic in nature to reduce manufacture steps, including complicated machining, parts, and thereby costs and risk of failure. The channel is located at the trailing edge of the club head. The channel locating features can be cast into the club head. The adjustable weight systems provides a smaller displacement towards the heel or toe of the weight, but the heavier weight counter balances the smaller displacement of the weight member, allowing the user to shape golf ball flight by using a comparatively displacement of the weight member. The adjustable weighting system can be located and oriented in any desired manner on the club head so as to provide a desired center of gravity location, moment of inertia values, and resulting ball trajectory.

The weight can be attached and secured within the channel by opposite forces and friction. Specifically, the screw will push, not thread, against one wall while the weight pushes against an opposite, parallel wall. These opposite forces from the screw and weight will apply a sufficient amount of pressure on the walls of the channel so that frictional forces will secure and prevent the weight from moving within the channel. The opposite forces created from the screw and weight are achieved by threading the screw through a threaded bore within the weight, so that when the screw is tightened, the screw will extend all the way through the weight and push against a wall of the channel. As the screw is further tightened, the weight will translate toward a channel wall opposite the wall which the screw abuts. Once sufficiently tightened, the screw will be pushing against one wall while the weight is pushing against an opposite wall.

The weight and screw are positioned in the channel by the use of notches and locating features. The notches guide the screw and weight into distinct positions. Once the weight is within the channel and the screw within the notch, the screw may be tightened to abut a corresponding locating feature. The locating feature maintains the distinct positioning of the weight in a secured configuration while the notches maintain the distinct position of the weight in an unsecured configuration. Details of the weight system and structures are explained in further detail below.

Figure 3:
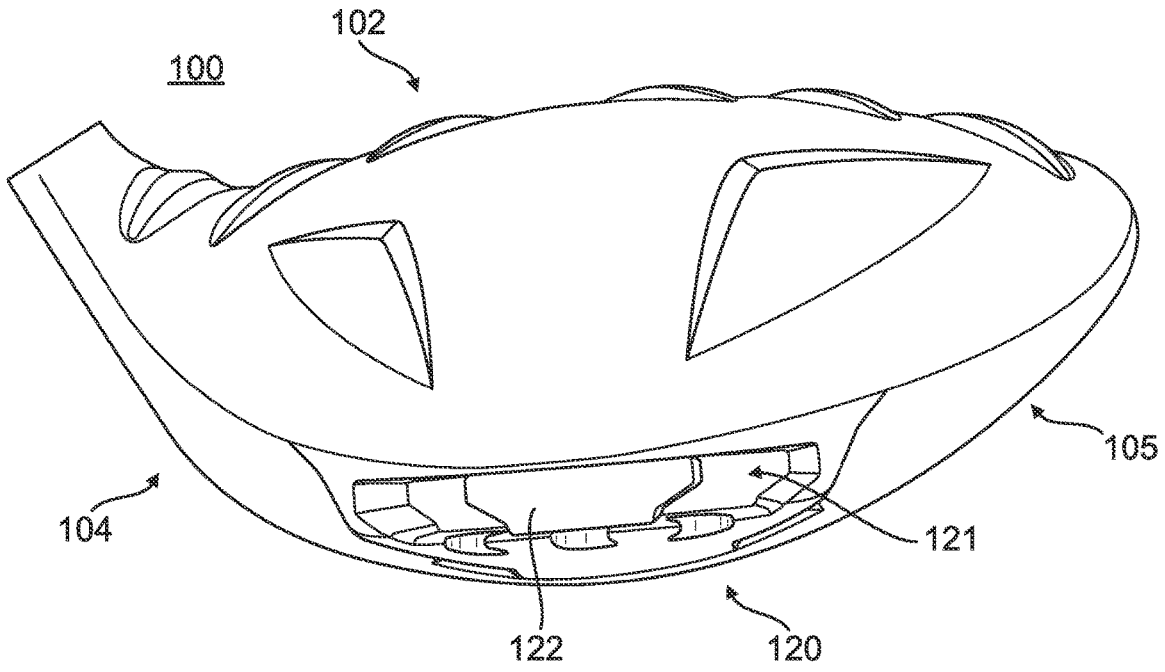
FIG. 3 illustrates a rear view of the golf club head of FIG. 1.
Figure 4:
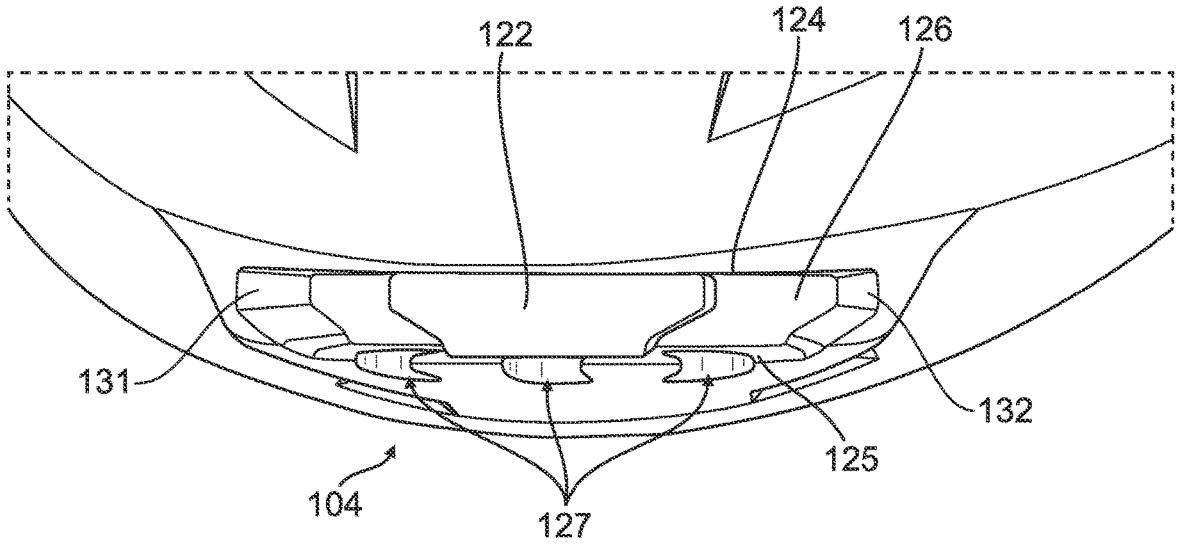
FIG. 4 illustrates a rear detailed view of the golf club head of FIG. 1.

Referring now to the drawings, FIGS. 1-8 illustrate an exemplary embodiment of an adjustable weight system according to aspects of the present invention. As illustrated in FIGS. 1-3, a golf club head 100 comprises a strike face 101, a crown portion 102, a sole portion 103 opposite the crown portion 102, a heel portion 104, a toe portion 105 opposite the heel portion 104, a rear portion 106, a hosel 107, and a skirt portion 108 which is defined by the transition between the crown portion 102 and sole portion 103. The strike face 101, crown portion 102, sole portion 103, heel portion 104, toe portion 105, rear portion 106, hosel 107, and skirt portion 108 define a hollow interior of the club head 100. The golf club head 100 further comprises a coordinate system as defined above which includes a geometric center 110, x-axis 111, y-axis 112, and a z-axis 113. The golf club head 100 further comprises a center of gravity 114 (CG) is the origin of a secondary coordinate system as defined above. The secondary coordinate system includes an x'-axis 115, y'-axis 116, and a z'-axis 117.

As mentioned above, the club head 100 further comprises a weight system 120 located in the rear 106 of the club head 100 along the periphery. As mentioned above, the weight system 120 comprises a channel 121, a weight 122, and a screw 123. The channel 121 does not comprise any threaded bores through the walls. The channel 121 comprises locating features 128 and notches 127 to provide distinct positions for the weight within the channel 121.

A. Channel

As illustrated in FIGS. 3-8, the channel 121 can be defined within the golf club head 100. In many embodiments, the channel 121 can be defined in a peripheral region of the golf club head 100. For example, the channel 121 can be defined in a toe periphery, heel periphery, or rear periphery region. In other embodiments, the channel 121 can be defined in another external region of the golf club head 100. The channel 121 comprises a top wall 124, bottom wall 125, and a vertical wall 126. The top wall 124 comprises locating features 128 and is approximately parallel to the bottom wall 125. The bottom wall 125 comprises notches 127. In the illustrated embodiment, both the top wall 124 and the bottom wall 125 are approximately parallel to the ground plane. In other embodiments, the top wall 124 and the bottom wall 125 can be angled relative to the ground plane, but approximately parallel to one another. The vertical wall 126 can extend between the top wall 124 and bottom wall 125 in a generally crown to sole direction, approximately perpendicular to the top wall 124 and the bottom wall 125. The vertical wall 126 can be arcuate along its length, following the general contour of the club head 100, when viewed from either a top or bottom view. The channel 121 can extend from a heel side wall 131, around the periphery, to a toe side wall 132 in an arcuate manner in a rear periphery region. The channel 121 has a relatively smaller arc when compared to other weight channels. The combination of a single, smaller channel with a single, heavy weight (i.e., over 12 g) member leads to improvements in CG movement, while preserving MOI. The smaller arc provides a smaller displacement towards the heel or toe of the golf club head, while the heavier weight counterbalances the smaller displacement of the weight member, allowing the user to shape golf ball flight by using a comparatively smaller displacement of the weight member.

The channel 121 comprises a length measured from the heel side wall 131 to the toe side wall 132, along the length of the vertical wall 131. The channel length may vary between 1.0 inch and 3.0 inches. For example, the channel length may vary between 1.0 inch and 1.5 inches, 1.5 inches and 2.0 inches, 2.0 inches and 2.5 inches, or 2.5 inches and 3.0 inches. In some embodiments, the length of the channel may be 1.0 inch, 1.1 inches, 1.2 inches, 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, or 3.0 inches. In some embodiments, the channel length may be less than 1.5 inches, less than 2.0 inches, less than 2.5 inches, or less than 3.0 inches. In the illustrated embodiments, the length of the channel is approximately 2.1 inches.

The channel 121 further comprises a height measured as the distance from the top wall 124 to the bottom wall 125. The weight channel height can vary at different positions in the weight channel due to taper angles. If taper angles are present, the weight channel height may be measured at the point closest to the vertical wall 126, where the top wall 124 and bottom wall 125 transition to the vertical wall 126. The channel height can vary between 0.20 inch and 0.40 inch. For example, the channel height can vary between 0.20 inch and 0.25 inch, 0.25 inch and 0.30 inch, 0.30 inch and 0.35 inch, or 0.35 inch and 0.40 inch. In some embodiments the channel height may be 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, or 0.40 inch. In the illustrated embodiment, the channel height is approximately 0.27 inch.

The channel 121 can form a percentage of the total skirt or periphery of the club head. The channel 121 can form a percentage of the skirt ranging between 12% and 35% of the total length of the skirt. For example, the channel 121 can form between 12% and 15%, 15% and 20%, 20% and 25%, 25% and 30%, or 30% and 35% of the total length of the skirt. In the illustrated embodiment, the channel 121 forms about 22% of the skirt of the club head.

Figure 9:
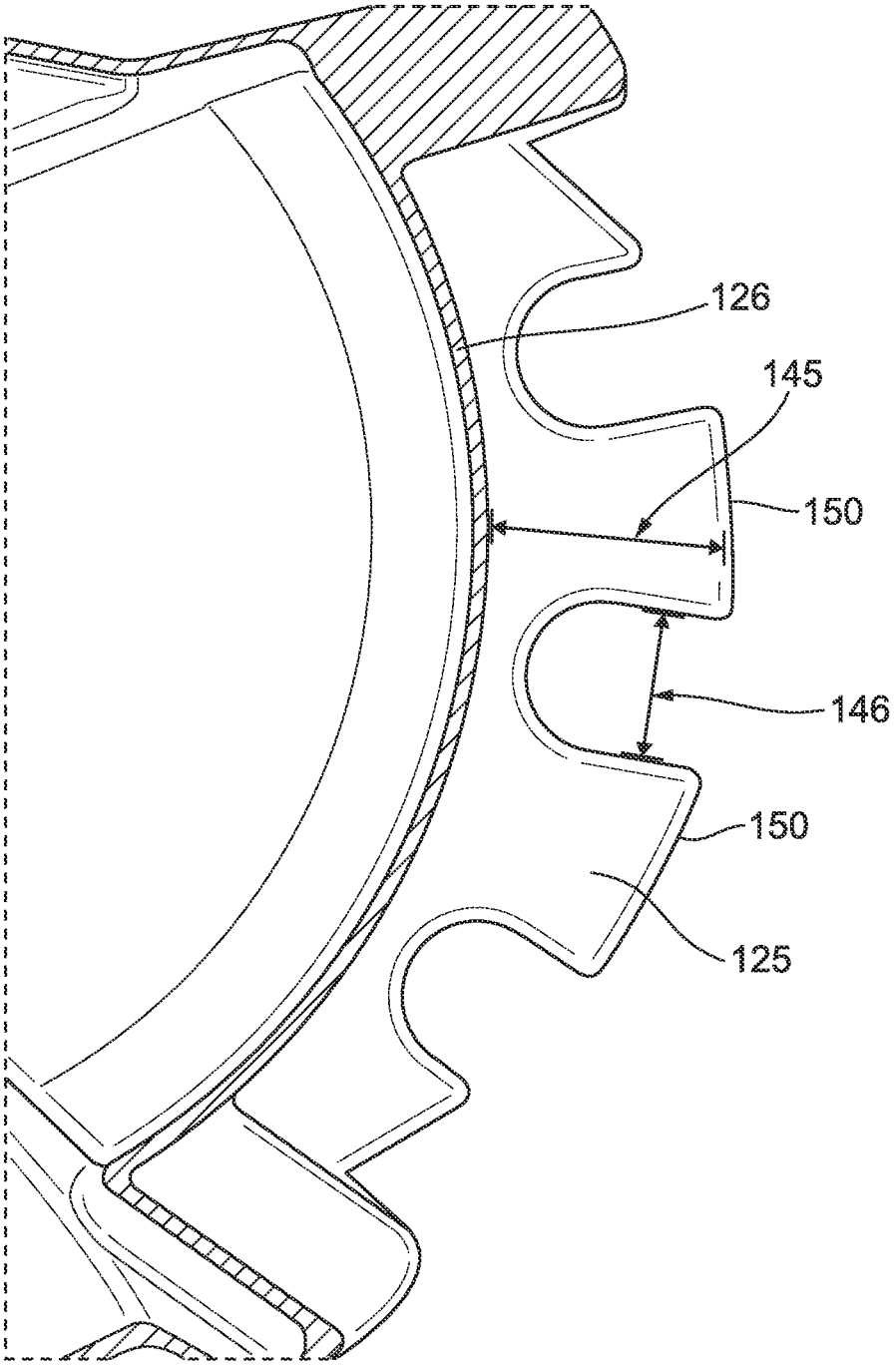
FIG. 9 illustrates a cross-sectional top view of the golf club head of FIG. 1.

Referring to FIG. 9 and as described above, the bottom wall 125 of the channel 121 can further define notches 127. The notches 127 could also be considered apertures or slots through the bottom wall 125. Each notch 127 creates an opening in the bottom wall 125 so that the screw 123 may be accessed by a tool from the sole side of the club head 100. The notches 127 create distinct locations for the weight 122 to be positioned, and prevent the weight 122 from being secured elsewhere within the channel 121. The notches can have any of a variety of shapes or geometry so as to provide access to the screw 123, and to provide distinct locations for weight 122 placement. For example, the notches may be any one of combination of the following shapes: rectangular, circular, semi-circular, triangular, or other various shapes. In the illustrated embodiment, the notches 127 have a pill-shaped geometry or a semi-circular shape. The notches 127 could also be described as harbors or slots, such that the notches 127 create a peninsula-type structure or wall between the notches 127. The notches are separated by an intermediate edge 150. The intermediate edge 150 forms a portion of the rear-most periphery of the club head 100.

The notches 127 comprise a width 146, measured in an approximately heel to toe direction across the notch, from one side of the notch to the other. The width 146 can range between approximately 0.20 inch and approximately 0.35 inch. For example, the width can range from 0.20 inch to 0.25 inch, 0.25 inch to 0.30 inch, or 0.30 inch to 0.35 inch. In the illustrated embodiment, the width 146 of the notch is approximately 0.26 inch.

The notches 127 comprise an arc length, measured as the distance around the curved portion of the notches 127. The arc length can range from 0.3 inch to 0.55 inch. For example, the arc length can range from 0.3 inch to 0.35 inch, 0.35 inch to 0.40 inch, 0.40 inch to 0.45 inch, 0.45 inch to 0.50 inch, or 0.50 inch to 0.55 inch. In some embodiments, the arch length can be 0.30 inch, 0.32 inch, 0.34 inch, 0.36 inch, 0.38 inch, 0.40 inch, 0.42 inch, 0.44 inch, 0.46 inch, 0.48 inch, 0.50 inch, 0.52 inch, or 0.55 inch. In the illustrated embodiment, the arc length is approximately 0.41 inch.

The notches 127 further comprise a radius of curvature which define the curved portion of the notches 127. The radius of curvature can range from approximately 0.10 inch to 0.20 inch. For example, the radius of curvature can range from approximately 0.10 inch to 0.15 inch, or 0.15 inch to 0.20 inch. In some embodiments, the radius of curvature can be 0.10 inch, 0.11 inch, 0.12 inch, 0.13 inch, 0.14 inch, 0.15 inch, 0.16 inch, 0.17 inch, 0.18 inch, 0.19 inch, or 0.20 inch. In the illustrated embodiment, the radius of curvature is approximately 0.13 inch.

In some embodiments, each notch in the plurality of notches can comprise symmetry when viewed from a bottom or top view. In other embodiments, each notch in the plurality of notches can be asymmetric. Further, in some embodiments, some notches in the plurality of notches may comprise symmetry while other notches in the plurality of notches may comprise asymmetry.

As illustrated in FIG. 9, the bottom wall 125 extends rearwardly, or toward the periphery, away from the vertical wall 126 by an extension distance 145. The extension distance 145 is measured from the vertical wall 126 to a rear most point of the channel, measured perpendicular to the vertical wall 126. The extension distance is measured at a point in the channel between the notches 127. In many embodiments, the extension distance 145 is consistent along the length of the channel 121. The bottom wall 125 can extend rearwardly by an extension distance 145 ranging from 0.20 inch to 0.45 inch. For example, the bottom wall 125 can extend rearwardly by an extension distance 145 ranging from 0.20 inch to 0.25 inch, 0.25 inch to 0.30 inch, 0.30 inch to 0.35 inch, 0.35 inch to 0.40 inch, 0.40 inch to 0.45 inch. In some embodiments the bottom wall 125 can extend rearwardly by an extension distance 145 of 0.20 inch, 0.21 inch, 0.22 inch, 0.23 inch, 0.24 inch 0.25 inch, 0.26 inch, 0.27 inch, 0.28 inch, 0.29 inch, 0.30 inch, 0.31 inch, 0.32 inch 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, or 0.45 inch. In the illustrated embodiment the bottom wall 125 extends rearwardly an extension distance 145 of approximately 0.37 inch.

It is an aspect of the present invention to provide a bottom wall 125 which extends a sufficient distance to provide proper surface area for the weight 122 to contact and press against when secured within the channel 121. If this distance is too small, (e.g., less than 0.15 inch), the weight 122 will not be able to apply enough pressure and frictional forces to stay within the channel 121 during impact, and may slide out of the channel 121. In many embodiments, the bottom wall 125 may extend as far as the top wall 124. In other embodiments, the bottom wall 125 may extend beyond the top wall 124. The weight 122 may be entirely concealed by the bottom wall 125, except for the exposure of the weight 122 in the notches 127. In other words, the bottom wall 125 extends further rearwardly than the weight 122, or an equivalent distance as the weight 122, when the weight 122 is in a secured position within the channel 121.

The bottom wall 125 comprises a surface area, measured on the inner surface of the bottom wall 125. The surface area can range from approximately 0.200 $in^2$ to 0.600 $in^2$. For example, the surface area of the bottom wall 125 can range from 0.200 $in^2$ to 0.250 $in^2$, 0.250 $in^2$ to 0.300 $in^2$, 0.300 $in^2$ to 0.350 $in^2$, 0.350 $in^2$ to 0.400 $in^2$, 0.400 $in^2$ to 0.450 $in^2$, 0.450 $in^2$ to 0.500 $in^2$, 0.500 $in^2$ to 0.550 $in^2$, or 0.550 $in^2$ to 0.600 $in^2$. In the illustrated embodiment, the bottom wall surface area is approximately 0.329 $in^2$.

Similarly, the top wall 124 comprises a surface area, measured on the inner surface of the top wall 124. The surface area of the top wall 124 does not include the surface area of the locating features 128. The surface area is of the flat surface of the top wall 124. The surface area of the top wall 124 can range from 0.70 $in^2$ to 1.00. For example, the surface area of the top wall 124 can range from 0.70 $in^2$ to 0.75 $in^2$, 0.75 $in^2$ to 0.80 $in^2$, 0.80 $in^2$ to 0.85 $in^2$, 0.85 $in^2$ to 0.90 $in^2$, 0.90 $in^2$ to 0.95 $in^2$, or 0.95 $in^2$ to 1.00 $in^2$. In the illustrated embodiment, the top wall surface area is approximately 0.89 $in^2$.

The channel 121 can comprise any desired number of notches 127 as to provide a particular amount of weight 122 placement options. For example, the channel 121 may comprise 1 to 5 notches 127. In some embodiments, the channel 121 comprises 1 notch, 2 notches, 3 notches, 4 notches, or 5 or more notches. In the illustrated embodiment, the channel 121 comprises 3 notches. Each notch 127 has a corresponding locating feature 128.

Figure 5:
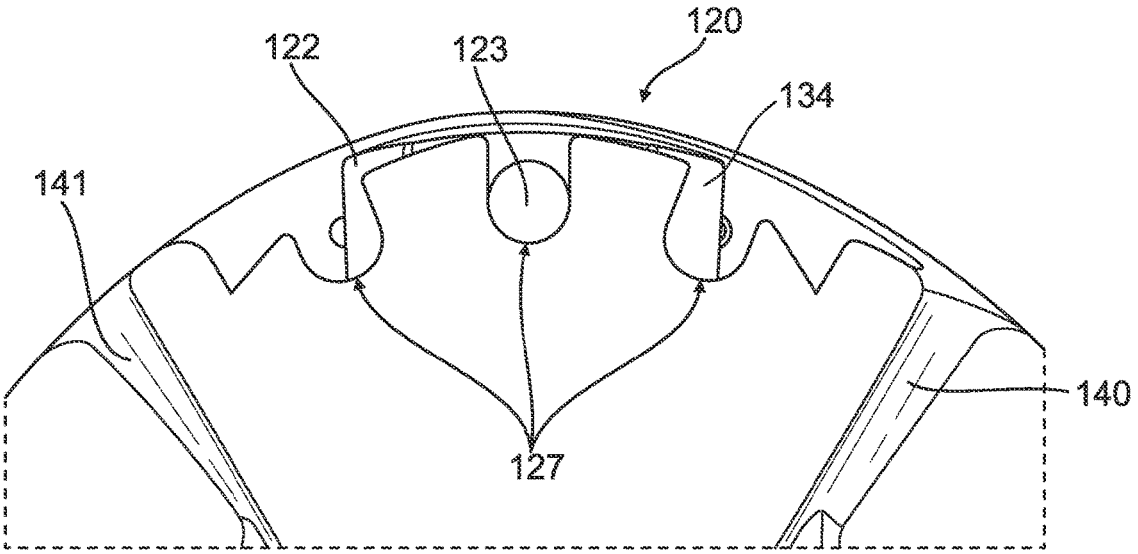
FIG. 5 illustrates a sole detailed view of the golf club head of FIG. 1.
Figure 8:
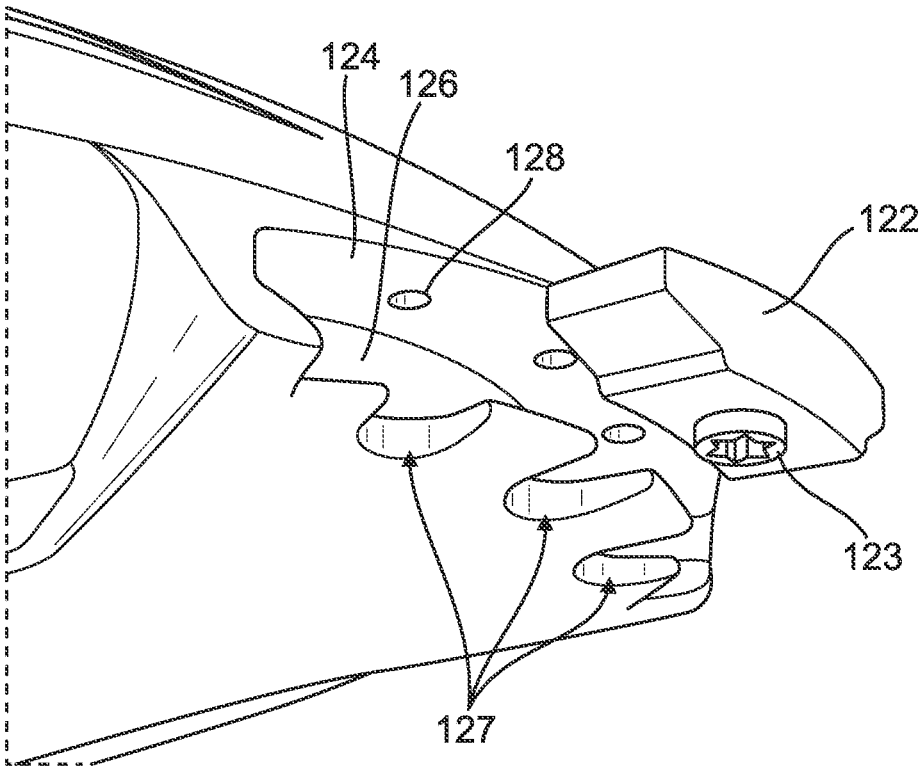
FIG. 8 illustrates a perspective assembly view of the golf club head of FIG. 1.

In this embodiment, the locating features 128 are defined in the top wall 124. In all embodiments, the locating features 128 are defined in or located on the wall that is opposite and parallel to the wall which comprise the notches 127. The locating features 128 are configured to receive or provide a surface to guide a tip end of the screw 123 into a set position. The locating features 128 can be recesses, notches, grooves, protrusions, or other various receiving structures. The locating features 128 do not have any threads. The locating features 128 preferably comprise geometries that can be casted with the club head, or otherwise easily machined or marked. In the illustrated embodiment, the locating features 128 are recesses. The locating features 128 are recessed toward the crown 102 as to provide an indentation in the top wall 124 that is configured to receive an end of the screw. Each locating feature 128 corresponds to a notch 127 in the bottom wall 125, such that each distinct weight location comprises a paired-up notch 127 and locating feature 128. The locating features 128 are in-line or concentric with the notches 127 when viewed from the bottom of the club head 100, as illustrated in FIG. 5 and FIG. 8. The locating features 128 and notches 127 are further concentric with the screw 123. Accordingly, the channel 121 has the same number of locating features 128 as notches 127.

In most embodiments, the locating features 128 and notches 127 are equally spaced apart. In other embodiments, the locating features 128 and notches 127 can be unevenly spaced apart. The locating features 128 and notches 127 can be located at any desired portion along the channel 121 as to provide sufficient adjustability of the weight 122. The positioning of the locating features 128 and notches 127 affects the amount of adjustability of the weight system 120 by determining the locations which the weight 122 can be secured within the channel 121.

Furthermore, the notches 127 prevent the weight 122 from sliding within the channel 121 when repositioning. The weight 122 may only be placed into the channel 121 at the distinct locations of the notches 127. Because the screw 123 will be protruding from the bottom of the weight 122, the screw 123 must be inserted into a notch 127 in order for the weight 122 to fit within the channel 121, and in order for the screw 123 to be accessed with a tool for tightening. Similarly, once the weight 122 is inserted into the channel 121, the notch 127 will prevent the screw 123 and weight 122 from slidably translating within the channel 121. Once the weight 122 is placed within the channel 121 at any of the one notch locations, the screw 123 may be tightened. Upon tightening of the screw 123, the screw 123 will threadedly translate upwards through the weight 122 so that the screw 123 will protrude from the top surface of the weight 122. The notches 127 allow tool access to the head of the screw 123. Once fully tightened, the screw 123 will mate with the locating features 128 to secure the weight 122 within the channel 121 and prevent any sliding.

The locating features 128 can be spaced apart a distance ranging from 0.3 inch to 0.9 inch.

For example, the locating features 128 can be spaced apart a distance ranging from 0.3 inch to 0.5 inch, 0.4 inch to 0.6 inch, 0.5 inch to 0.7 inch, 0.6 inch to 0.8 inch, or 0.7 inch to 0.9 inch. In some embodiments, the distance between locating features 128 can be 0.3 inch, 0.35 inch, 0.40 inch, 0.45 inch, 0.50 inch, 0.55 inch, 0.60 inch, 0.65 inch, 0.70 inch, 0.75 inch, 0.80 inch, 0.85 inch, or 0.90 inch. In the illustrated embodiment, the distance between locating features 128 is approximately 0.59 inch.

The channel 121 can be located and oriented in any desired manner to provide a desired center of gravity location and adjustability. For example, the channel 121 may be located in the heel portion 104, toe portion 105, rear portion 106, or sole portion 103. In the illustrated embodiment, the channel 121 is located in the rear portion 106 and sole portion 103 or transition region such that the channel 121 is located below the rear skirt and does not extend into the crown portion 102. Further, the channel 121 is oriented so that the weight 122 is inserted into the channel 121 from the rear. In other embodiments, the channel 121 may be oriented so that the weight 122 is inserted from the sole.

In some embodiments, the channel 121 may comprise ribs (not shown) attaching to or protruding from the top wall 124, bottom wall 125, or vertical wall 126 or any combination thereof. The ribs correspond to the position of the weight within the channel to further secure the weight. The ribs can further prevent sliding of the weight, while simultaneously reinforcing the channel walls. The ribs may be oriented parallel or perpendicular to the intermediate edges 150 or vertical wall 126. Ribs positioned proximate and parallel to the intermediate edges 150 prevent the weight 122 from sliding rearwardly out of the channel 121. Ribs that are positioned perpendicular to the intermediate edge 150 will prevent the weight 122 from sliding within the channel 121. In other embodiments, the bottom surface 124 of the weight may comprise complimentary geometry to the ribs such that the ribs are configured to mate with the complimentary geometry of the weight. As such, the ribs may act similar to the locating features described above and help guide the weight into distinct positions.

Figure 6:
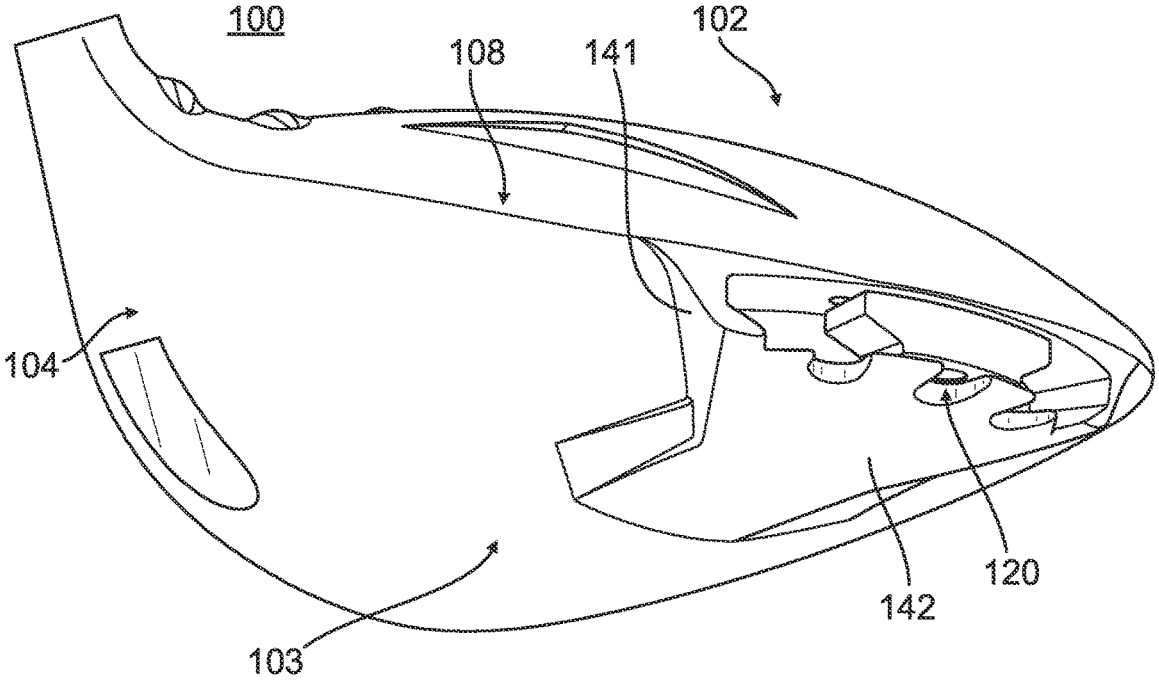
FIG. 6 illustrates a sole perspective view of the golf club head of FIG. 1.

As illustrated in FIGS. 5 and 6, the weight channel 121 comprises a toe extended platform wall 140 and a heel extended platform wall 141 which protrudes downward, toward the ground plane. The toe extended platform wall 140 and heel extend platform wall 141 are connected by a sole platform wall 142. The toe extended platform wall 140 and heel extended platform wall 140 allow the sole platform wall 142 and thereby the weight system to be placed as close to the ground plane to position the weight as far back and as far down as possible.

B. Weight

As mentioned above, and illustrated in FIGS. 7 and 8, the weight system 120 comprises a single weight 122 that is configured to be received by the channel 121. The single weight 122 reduces the number of assembly parts, thereby decreasing manufacturing complexities and costs. The single weight 122 comprises a threaded through bore which is configured to receive the screw 123. As such, the overall weight system 120 comprises a single threaded bore that is not in the channel 121. The shape of the single weight 122 is complimentary to the channel 121. The weight 122 is positioned in a rear periphery region to move the CG to a low and back position. The weight 122 can also be adjusted to other portions within the channel 121 to manipulate the flight path of the ball to produce a draw or fade bias. For example, the weight 122 can be positioned to adjust the ball flight up to 10 yards in curvature.

The weight 122 comprises a top surface 133 and a bottom surface 123, and a threaded bore 135 which extends from the top surface 133 to the bottom surface 134 of the weight 122. The top surface 133 is configured to be placed adjacent to the top wall 124 of the channel 121. The bottom surface 134 is configured to abut the bottom wall 125 of the channel 121. Due to the fastening mechanism, the top surface 133 of the weight 121 will be offset a distance from the top wall 124 when the weight is secured within the channel, creating a gap. The tolerance of the gap between the top surface 133 and the top wall 124 is preferably not more than 0.010 inch when the weight is in a secured configuration.

The weight 122 can be made of a high-density metal such as tungsten or any other suitable metal material. The high-density weight 122 can have a mass ranging from 1 gram to 70 grams. For example, the weight 122 mass can be 1 gram, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, or 30 grams, 40 grams, 41 grams, 42 grams, 43 grams, 44 grams, 45 grams, 46 grams, 47 grams, 48 grams, 49 grams, 50 grams, 51 grams, 52 grams, 53 grams, 54 grams, 55 grams, 56 grams, 57 grams, 58 grams, 59 grams, 60 grams, 61 grams, 62 grams, 63 grams, 64 grams, 65 grams, 66 grams, 67 grams, 68 grams, 69 grams, 70 grams. In the illustrated embodiment, the weight 122 has a mass of 35 grams. The use of a heavy weight (e.g. greater than 12 grams) can have a greater impact on the mass properties of the club head 100, and allows the channel 121 length to be made smaller. A heavy weight can provide the same center of gravity adjustability when moved in shorter increments than a light weight that moves to points further away in a longer channel.

The threaded bore in the weight 122 is configured to receive the screw 123. As mentioned above, the screw 123 will thread through the weight so the threads push the weight 122 in an opposite direction of the screw 123 translation. In other words, the screw 123, when tightened, will translate upwards (i.e., towards the crown). Due to the threads, the weight will be pushed downwards (i.e., towards the sole). Specifically, once the screw has translated the full extent allowable such that its tip end 129 abuts the locating feature or region surrounding the location feature, further tightening of the screw results in translation of the weight toward the bottom wall. As such, the bore and the screw must be designed to allow for proper translation. The threaded bore in the screw comprises a single diameter, not including the thread. The diameter is measured from the interior surface of the bore in which either the threads protrude or indent.

C. Screw

The weight system screw 123 comprises a head 130, a body, and a tip 129. The body of the screw 122 comprises corresponding threads to the weight 122. The head 130 is used to drive the screw via a tool. The screw tip 129 is configured to be received by the locating features 128 described above. In this embodiment, the tip 129 is a rounded protrusion. The rounded protrusion has a smaller diameter than the body of the of the screw. In other embodiments, the tip 129 may protrude with various geometries or may be a recess. The tip 129 geometry comprises mating geometry to the locating feature 128. The tip 129 of the screw does not necessarily apply pressure to the locating features 128 when the weight is pressing against the bottom wall. The pressure from the screw may be applied to the surface surrounding the protrusions, which applies pressure to the top wall of the channel.

The head 130 of the screw 123 has a diameter than is equal to or smaller than the diameter of the shaft portion which comprises the threads. The head 130 should have a diameter that is equal to or smaller than the shaft so that the head does not prevent the weight 122 from translating in an opposite direction of the screw 123. The head 130 does not push against the weight 122 at any point.

The screw 123 can made from any well-known material with sufficient strength and hardness to provide proper durability. In some examples, the screw 123 can made from any metallic material, such as steel, aluminum, titanium, copper, tungsten, zinc, brass, or other well-known alloys or combination thereof.

The mass of the screw 123 can range from approximately 1 gram to 10 grams. For example, the mass of the screw 123 may range from 1 to 3 grams, 3 to 5 grams, 5 to 7 grams, or 7 to 10 grams. In some embodiments, the mass of the screw 123 can be 1 gram, 2 grams, 3 grams, 4 grams, 5 grams, 6 grams, 7 grams, 8 grams, 9 grams, or 10 grams.

D. Weight Assembly

Together, the channel 121, the weight 122, and the screw 123 form the weight system 120. The weight system 120 has distinct, prescribed, predetermined locations for the weight 122 to be positioned within the channel 121. The distinct locations are defined by the locating features 128 and notches 127 located on the top wall 124 and bottom wall 125, respectively. The weight 122 with the threaded screw 123 is placed into the channel 121 at the distinct locations through the rear of the club. The threaded screw 123 is threaded into the weight 122 prior to the placement of the weight within the channel 121.

Figure 7:
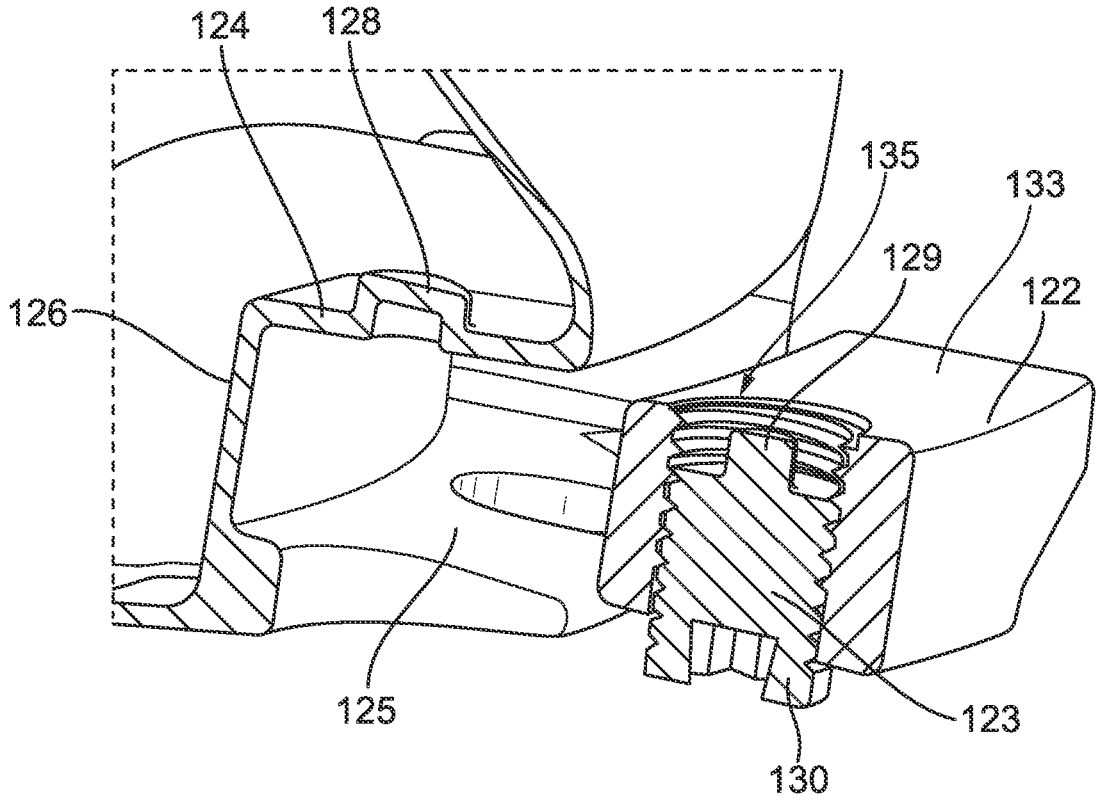
FIG. 7 illustrates a cross-sectional assembly view of the golf club head of FIG. 1.

During adjustment of the weight 122 placement, as illustrated in FIGS. 7 and 8, the screw is unscrewed so that the tip end does not protrude past the top surface of the weight and the head of the screw may protrude downwardly, beyond the bottom surface of the weight. In this configuration, the notches will guide the screw to a predetermined location such that the screw is concentric with a notch. Furthermore, the notches allow access to the head of the screw for a tool to tighten and torque the screw. Upon tightening the screw, the head of the screw will eventually sit flush or be slightly recessed with the bottom surface of the weight. Accordingly, the tip of the screw will protrude from the top surface of the weight. Upon tightening, the tip of the screw will come in contact with the corresponding locating feature on the top wall. The locating feature further secures the weight to a predetermined position and prevents the weight from sliding within the channel.

In a secured configuration, the screw pushes against the top wall, thereby forcing the weight downward to push against the bottom wall. The opposite forces from the screw and weight against the channel will secure the weight. The pressure from the weight and screw on the surface of the walls creates a high frictional force. The frictional force is the primary factor securing the weight within the channel.

FIGS. 1-9 illustrate one embodiment of the weight system described above. In the illustrated embodiment, the weight system 120 is implemented in a driver-type club head. In other embodiments, the weight system may be implemented in other wood-type club heads such as fairway woods and hybrid type club heads. The overall dimensions and geometries of the weight system can be adjusted accordingly so that the weight system which lacks threaded bores may be successfully implemented into other wood-type club heads.

II. Advantages

The weight system described above provides several advantages over prior weight systems.

These advantages include reducing the overall cost of manufacturing and assembly by reducing steps and parts. Specifically, the weight channel lacks threaded bores in or through the titanium body which are costly and time consuming due to complicated machining processes. Minimizing the use of threading further reduces risk of failure by avoiding thin structures and potential stress accumulation. Furthermore, the weight assembly comprising a single weight and a single screw, which reduces the overall assembly parts, and thereby, assembly steps.

Another advantage of the weight system described above is that the weight system uses a heavy weight member, which leads to improvements in CG movement and MOI preservation. This is achieved by confining the channel to a relatively small arc on the rear of the golf club head. Smaller maximum angular separation between weight positions provides a smaller displacement of the weight member towards the heel or toe of the golf club head. However, the heavy weight member counterbalances the smaller maximum angular separation of the weight member and allows the user to the shape golf ball flight by using a comparatively smaller weight member displacement while also preserving more of the total MOI and forgiveness of the golf club head.

EXAMPLES

III. Example 1

Durability Test

A durability test was conducted to compare an exemplary embodiment of the present invention to a control club head. The exemplary club head was a driver type club head comprising a weight assembly similar to that described herein with regard to club head 100. The exemplary club head comprised a rear weight channel, a weight, and a screw. The channel did not have any threaded bores through the body of the club head. The weight channel was identical to the embodiment illustrated in FIGS. 1-9 in that the channel had three notches, three locating features, and the same overall dimensions and geometries. The weight of the exemplary embodiment was approximately 14 grams.

The control club head was a driver type club head comprising a rear weight channel, a weight, and a screw. The control club head had a channel in which there was threaded bore through the walls of the channel. The threaded bore was configured to receive the threaded screw. The control club head channel did not have notches. The control club head weight has a mass of about 14 grams.

The durability test was conducted using a robotic arm. The robotic arm imitates a real swing from a golfer. The robotic arm was programed to hit golf balls at 150 mph in the center of the face until failure occurs or until 500 hits have been executed.

The results of the durability indicated that both the exemplary club head and the control club head passed and achieved 500 hits without failure. Therefore, the exemplary club head comprising no threaded bores through the weight channel achieved the same sufficient durability as the control club head which had threaded bores through the walls of the weight channel. The weight of the exemplary club head is sufficiently secured to the channel to achieve desired durability.

Clauses

Clause 1. A golf club head comprising: a crown, a sole, a toe portion, a heel portion, a rear portion, and a strike face; wherein the crown, sole, toe portion, heel portion, rear portion, and strike face form a hollow interior; a channel formed in the rear portion; a weight configured to be received by the channel; a screw configured to threadedly fasten to the weight; wherein: the channel is defined by a top wall, a bottom wall, a vertical wall, a toe wall, and a heel wall; the top wall is approximately parallel to the bottom wall and a ground plane such that the channel opens to the rear portion of the golf club head; the bottom wall comprises a plurality of notches; the top wall comprises a plurality of locating features; and each notch in the plurality of notches are associated and concentric with each locating feature in the plurality of locating features, when viewed from a bottom view of the club head.

Clause 2. The golf club head of clause 1, wherein the channel does not comprise any threaded bores through the top wall, bottom wall, or vertical wall.

Clause 3. The golf club head of clause 2, wherein the weight comprises a top surface and a bottom surface; wherein the weight comprises a threaded bore extending through the top surface to the bottom surface; wherein the bore comprises a bore diameter.

Clause 4. The golf club head of clause 3, wherein the screw comprises a head end and a tip end and a shaft extending between the head and a tip end; wherein the tip end comprises a protrusion; wherein the tip end is configured to abut at least one locating feature of the plurality of locating feature when the weight is in an installed position.

Clause 5. The golf club head of clause 4, wherein the screw, at least one notch in the plurality of notches, and at least one locating feature in the plurality of locating features are concentric when the weight is an installed position.

Clause 6. The golf club head of clause 4, wherein the locating features are separated by a distance of at most 0.6 inch.

Clause 7. The golf club head of clause 6, wherein the bottom wall extends rearwardly a distance of at least 0.35 inch.

Clause 8. The golf club head of clause 7, wherein each notch in the plurality of notches comprises a width ranging from about 0.2 inch to 0.3 inch.

Clause 9. The golf club head of clause 7, wherein the bottom wall extends more rearwardly than the weight when in the weight is in an installed position.

Clause 10. The golf club head of clause 9, wherein the notches are separated by an intermediate edge; wherein the intermediate edges form a portion of a rear periphery of the club head.

Clause 11. A golf club head comprising: A crown, a sole, a toe portion, a heel portion, a rear portion, and a strike face; wherein the crown, sole, toe portion, heel portion, rear portion, and strike face form a hollow interior; a channel formed in the rear portion; a weight configured to be received by the channel; a screw configured to threadedly fasten to the weight; wherein: the channel is defined by a top wall, a bottom wall, a vertical wall, a toe wall, and a heel wall; the bottom wall comprises a plurality of notches; the top wall comprises a plurality of locating features; and the plurality of notches and the plurality of locating features define distinct positions for the weight to be placed within the channel.

Clause 12. The golf club head of clause 11, wherein the channel does not comprise any threaded bores through the top wall, the bottom wall, or the vertical wall.

Clause 13. The golf club head of clause 12, wherein the weight comprises a top surface and a bottom surface; wherein the weight comprises a threaded bore extending through the top surface to the bottom surface; wherein the bore comprises a bore diameter.

Clause 14. The golf club head of clause 13, wherein the screw comprises a head end and a tip end and a shaft extending between the head and a tip end; wherein the tip end comprises a protrusion; wherein the tip end is configured to abut at least one locating feature of the plurality of locating feature when the weight is in an installed position.

Clause 15. The golf club head of clause 14, wherein the screw, at least one notch in the plurality of notches, and at least one locating feature in the plurality of locating features are concentric when the weight is an installed position.

Clause 16. The golf club head of clause 14, wherein the locating features are separated by a distance of at most 0.6 inch.

Clause 17. The golf club head of clause 16, wherein the bottom wall extends rearwardly a distance of at least 0.35 inch.

Clause 18. The golf club head of clause 17, wherein each notch in the plurality of notches comprises a width ranging from about 0.2 inch to 0.3 inch.

Clause 19. The golf club head of clause 17, wherein the bottom wall extends more rearwardly than the weight when in the weight is in an installed position.

Clause 20. The golf club head of clause 19, wherein the notches are separated by an intermediate edge; wherein the intermediate edges form a portion of a rear periphery of the club head.

Clause 21. A golf club head comprising: A crown, a sole, a toe portion, a heel portion, a rear portion, and a strike face; wherein the crown, sole, toe portion, heel portion, rear portion, and strike face form a hollow interior; a channel formed in the rear portion; a weight configured to be received by the channel; a screw configured to threadedly fasten to the weight; wherein: the channel is defined by a top wall, a bottom wall, a vertical wall, a toe wall, and a heel wall; the bottom wall comprises a plurality of notches; the top wall comprises a plurality of locating features; the plurality of notches and the plurality of locating features define distinct positions for the weight to be placed within the channel; and wherein in an installed configuration, the screw pushed against the top wall and the weight pushes against the bottom wall.

Clause 22. The golf club head of clause 21, wherein the channel does not comprise any threaded bores through the top wall, the bottom wall, or the vertical wall.

Clause 23. The golf club head of clause 22, wherein the weight comprises a top surface and a bottom surface; wherein the weight comprises a threaded bore extending through the top surface to the bottom surface; wherein the bore comprises a bore diameter.

Clause 24. The golf club head of clause 23, wherein the screw comprises a head end and a tip end and a shaft extending between the head and a tip end; wherein the tip end comprises a protrusion; wherein the tip end is configured to abut at least one locating feature of the plurality of locating feature when the weight is in an installed position.

Clause 25. The golf club head of clause 24, wherein the screw, at least one notch in the plurality of notches, and at least one locating feature in the plurality of locating features are concentric when the weight is an installed position.

Clause 26. The golf club head of clause 24, wherein the mass of the weight ranges from approximately 20 grams to 40 grams.

Clause 27. The golf club head of clause 26, wherein the bottom wall further comprises ribs;

wherein the bottom surface of the weight comprises complimentary geometry to the ribs.

Clause 28. The golf club head of clause 27, wherein the bottom surface of the weight comprises complimentary geometry to the ribs.

Clause 29. The golf club head of clause 27, wherein the bottom wall extends more rearwardly than the weight when the weight is in an installed position.

Clause 30. The golf club head of clause 29, wherein the notches are separated by an intermediate edge; wherein the intermediate edges form a portion of a rear periphery of the club head.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to $ocm^3ur$ or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a crown, a sole, a toe portion, a heel portion, a rear portion, and a strike face;

wherein the crown, sole, toe portion, heel portion, rear portion, and strike face form a hollow interior;

a channel formed in the rear portion;

a weight configured to be received by the channel;

a screw configured to threadedly fasten to the weight;

wherein:

the channel is defined by a top wall, a bottom wall, a vertical wall, a toe wall, and a heel wall;

the top wall is approximately parallel to the bottom wall and a ground plane such that the channel opens to the rear portion of the golf club head;

the bottom wall comprises a plurality of notches;

the top wall comprises a plurality of locating features; and each notch in the plurality of notches are associated and concentric with each locating feature in the plurality of locating features, when viewed from a bottom view of the golf club head.

2. The golf club head of claim 1, wherein the channel does not comprise any threaded bores through the top wall, the bottom wall, or the vertical wall.

3. The golf club head of claim 2, wherein the weight comprises a top surface and a bottom surface; wherein the weight comprises a threaded bore extending through the top surface to the bottom surface; wherein the threaded bore comprises a bore diameter.

4. The golf club head of claim 3, wherein the screw comprises a head end and a tip end and a shaft extending between the head end and the tip end; wherein the tip end comprises a protrusion; wherein the tip end is configured to abut at least one locating feature of the plurality of locating features when the weight is in an installed position.

5. The golf club head of claim 4, wherein the screw, at least one notch in the plurality of notches, and at least one locating feature in the plurality of locating features are concentric when the weight is in the installed position.

6. The golf club head of claim 4, wherein the locating features are separated by a distance of at a maximum of 0.6 inch.

7. The golf club head of claim 6, wherein the bottom wall extends rearwardly a distance of at least 0.35 inch.

8. The golf club head of claim 7, wherein each notch in the plurality of notches comprises a width ranging from about 0.2 inch to 0.3 inch.

9. The golf club head of claim 7, wherein the bottom wall extends more rearwardly than the weight when in the weight is in the installed position.

10. The golf club head of claim 9, wherein the notches are separated by an intermediate edge; wherein the intermediate edges form a portion of a rear periphery of the club head.

11. A golf club head comprising:

a crown, a sole, a toe portion, a heel portion, a rear portion, and a strike face;

wherein the crown, sole, toe portion, heel portion, rear portion, and strike face form a hollow interior;

a channel formed in the rear portion;

a weight configured to be received by the channel;

a screw configured to threadedly fasten to the weight;

wherein:

the channel is defined by a top wall, a bottom wall, a vertical wall, a toe wall, and a heel wall;

the bottom wall comprises a plurality of notches;

the top wall comprises a plurality of locating features;

the plurality of notches and the plurality of locating features define distinct positions for the weight to be placed within the channel; and wherein in an installed configuration, the screw pushed against the top wall and the weight pushes against the bottom wall.

12. The golf club head of claim 11, wherein the channel does not comprise any threaded bores through the top wall, the bottom wall, or the vertical wall.

13. The golf club head of claim 12, wherein the weight comprises a top surface and a bottom surface; wherein the weight comprises a threaded bore extending through the top surface to the bottom surface; wherein the threaded bore comprises a bore diameter.

14. The golf club head of claim 13, wherein the screw comprises a head end and a tip end and a shaft extending between the head end and the tip end; wherein the tip end comprises a protrusion; wherein the tip end is configured to abut at least one locating feature of the plurality of locating features when the weight is in an installed position.

15. The golf club head of claim 14, wherein the screw, at least one notch in the plurality of notches, and at least one locating feature in the plurality of locating features are concentric when the weight is in the installed position.

16. The golf club head of claim 14, wherein a mass of the weight ranges from approximately 20 grams to 40 grams.

17. The golf club head of claim 16, wherein the bottom wall further comprises ribs; wherein the bottom surface of the weight comprises complimentary geometry to the ribs.

18. The golf club head of claim 17, wherein the bottom surface of the weight comprises complimentary geometry to the ribs.

19. The golf club head of claim 17, wherein the bottom wall extends more rearwardly than the weight when in the weight is in the installed position.

20. The golf club head of claim 19, wherein the notches are separated by an intermediate edge; wherein the intermediate edges form a portion of a rear periphery of the club head.

* * * * *